US005645018A

United States Patent [19]

Ishibashi et al.

[11] Patent Number: 5,645,018

[45] Date of Patent: Jul. 8, 1997

[54] TWO CYCLE INTERNAL COMBUSTION ENGINE

[75] Inventors: Yoici Ishibashi; Masahiro Asai, both of Wako, Japan

[73] Assignee: Honda Giken Kogyo Kabushiki Kaisha, Tokyo, Japan

[21] Appl. No.: 716,623

[22] Filed: Sep. 19, 1996

[30] Foreign Application Priority Data

Sep. 19, 1995 [JP] Japan ..... 7-263696

[51] Int. Cl.[6] ..... F02M 35/10; F02B 75/02

[52] U.S. Cl. ..... 123/73 PP; 123/73 B; 123/65 A

[58] Field of Search ..... 123/73 R, 73 PP, 123/65 R, 73 B, 65 PE, 65 A

[56] References Cited

U.S. PATENT DOCUMENTS

| | | | |
|---|---|---|---|
| 3,916,851 | 11/1975 | Otani | 123/73 R |
| 4,191,141 | 3/1980 | Franke | 123/73 R |
| 4,248,185 | 2/1981 | Jaulmes | 123/73 R |
| 4,276,858 | 7/1981 | Jaulmes | 123/73 R |
| 5,271,358 | 12/1993 | Katoh et al. | 123/73 PP |

FOREIGN PATENT DOCUMENTS

| | | |
|---|---|---|
| 3-100318 | 9/1989 | Japan . |
| 5-302521 | 4/1992 | Japan . |

*Primary Examiner*—David A. Okonsky

*Attorney, Agent, or Firm*—Birch, Stewart, Kolasch & Birch, LLP

[57] ABSTRACT

A two-cycle internal combustion engine is provided which is capable of preventing the blow-by phenomenon, thereby improving both fuel economy and exhaust purifying performance, and superior in the response of fuel injection volume. In a two-cycle internal combustion engine wherein a chamber is disposed in scavenging passages which provide communication between a crank chamber and a combustion chamber, sealable control valves are disposed in an inlet and an outlet, respectively, of the chamber. A fuel feeding system is provided for the supply of fuel into the chamber. The chamber is brought into communication with one scavenging passage out of a plurality of parallel scavenging passages. The control valve, disposed in the chamber outlet which is on the combustion chamber side and on a scavenging downstream side, is positioned at the bottom part of the scavenging passage communicating with the chamber with respect to the control valve disposed in the chamber inlet which is on the crank chamber side.

20 Claims, 14 Drawing Sheets

EXPANSION, FILLING PRE-MIXING CHAMBER ATDC 45°

COMPRESSION-INTAKE
BTDC 45°

EXPANSION, FILLING PRE-MIXING CHAMBER
ATDC 45°

EXHAUST, AIR SCAVENGING
BDC

EXHAUST, FUEL SCAVENGING, INTAKE
BTDC 90°

TWO CYCLE INTERNAL COMBUSTION ENGINE

BACKGROUND OF THE INVENTION

1. Field of the Invention

The present invention relates to a two-cycle internal combustion engine capable of preventing a blow-by phenomenon of an air-fuel mixture in a combustion chamber to improve fuel economy and attain a high exhaust gas purifying performance.

2. Description of Background Art

In a conventional two-cycle internal combustion engine, fuel supplied by a carburetor, etc. is mixed with intake air and the resulting mixture is introduced into a crank chamber, the mixture is then supplied into a combustion chamber through a scavenging port. Since the timing of opening of an exhaust port is set earlier than that of the scavenging portion, the upper edge of the exhaust port is higher than that of the scavenging port, the mixture fed into the combustion chamber is discharged to an exhaust passage, thus easily causing what is called a blow-by phenomenon.

Although the blow-by phenomenon is suppressed by an exhaust pulsating effect in an exhaust chamber, it is difficult for the suppression to cover the whole operation range, resulting in that both fuel economy and exhaust purifying performance are affected.

In an effort to solve the above-mentioned problem, two-cycle internal combustion engines have been proposed in Japanese Patent Laid-open Nos. Hei 3-100318 and Hei 5-302521.

In the two-cycle internal combustion engine disclosed in Japanese Patent Laid-open No. Hei 3-100318, a high pressure chamber is connected to a crank chamber through a check valve, the high pressure chamber and a combustion chamber are interconnected through an air passage, a solenoid valve is disposed in the lower end of the air passage, and a fuel injection valve capable of ejecting fuel toward the combustion chamber is provided at the upper end of the air passage.

In the two-cycle internal combustion engine disclosed in Japanese Patent Laid-open No. Hei 5-302521, a chamber is formed in a position adjacent to both the crank case and the cylinder block. An intake control valve is interposed between a crank chamber and the chamber. A scavenging control valve is interposed between the chamber and a combustion chamber in a cylinder, and a fuel injection valve is provided for the ejection of fuel toward the chamber.

SUMMARY AND OBJECTS OF THE INVENTION

In the two-cycle internal combustion engine described in Japanese Patent Laid-open No. Hei 3-100318, of the fuel ejected from the fuel injection valve, the portion deposited on the air passage falls by gravity, then enters the crank chamber through a check valve disposed at the bottom of the air passage, and flows without being atomized into the combustion chamber from the interior of the crank chamber through another scavenging port. Therefore, the blow-by phenomenon is not prevented to a satisfactory extent and it is difficult to effect stable combustion. In addition, the amount of fuel fed into the combustion chamber is not appropriately controlled and thus the response is poor.

In the two-cycle internal combustion engine described in Japanese Patent Laid-open No. Hei 5-302521, the whole of the intake air in the crank chamber is introduced therein through the intake control valve into the chamber adjacent to both the crank chamber and the cylinder block. Thereafter, the air is mixed therein with the fuel which has been introduced into the chamber through the fuel injection valve, and the whole of the resulting mixture flows into the combustion chamber through the scavenging control valve. Thus, the two-cycle internal combustion engine in question is not constructed so as to permit only air to flow from the interior of the crank case into the combustion chamber through a scavenging port, and hence the blow-by phenomenon is unavoidable. Further, although an upstream side of the scavenging control valve is open to the lower portion of the chamber, the opening position is not the lowest position, so that the fuel injected into the chamber stays at the bottom of the chamber, thus giving rise to the problem that the amount of fuel fed into the combustion chamber cannot accurately be proportional to the amount of fuel injection and thus the response is low.

The present invention relates to an improvement in a two-cycle internal combustion engine which has overcome the above-mentioned problem. In a two-cycle internal combustion engine wherein a chamber is disposed in a scavenging passage communicating between a crank chamber and a combustion chamber, sealable control valves are disposed in an inlet and an outlet, respectively, of the chamber. A fuel feed system is provided for the supply of fuel into the chamber. The present invention is characterized in that the chamber is communicated with one of a plurality of parallel scavenging passages, and the control valve disposed in the chamber outlet, which is on the combustion chamber side and on a scavenging downstream side, is disposed at the bottom part of the scavenging passage communicating with the chamber with respect to the control valve disposed in the chamber inlet which is on the crank chamber side.

In the present invention, as mentioned above, a chamber is communicated with one of a plurality of parallel scavenging passages. Sealable control valves are disposed in an inlet and an outlet, respectively, of the chamber, and a fuel feed system is provided for the supply of fuel into the chamber. Therefore, in the initial stage of scavenging, the inlet and outlet control valves in the chamber are closed, allowing fresh air not containing fuel to be introduced into the combustion chamber through another scavenging passage, whereby the gas after combustion in the combustion chamber can be discharged positively from an exhaust port and hence it is possible to prevent the blow-by phenomenon of the air-fuel mixture in the combustion chamber. Besides, when the engine is operating at a low load, the scavenging efficiency can be improved by air scavenging.

In the present invention, the combustion chamber side control valve disposed in the chamber outlet, which is on the scavenging downstream side, is positioned at the lowest part of the scavenging passage with both control valves interposed therein, with respect to the crank chamber-side control valve. Thus, even if the fuel fed into the chamber from the fuel feed system is deposited on the inner wall of the chamber and stays at the lowest part of the scavenging passage communicating with the chamber, substantially the whole of the stagnant fuel can be discharged positively into the combustion chamber by a violent scavenging stream induced by intermittent opening and closing motions of the combustion chamber-side control valve located at the bottom of the scavenging passage, whereby it is possible to ensure a stable combustion state.

In the present invention, moreover, the fuel fed into the chamber from the fuel feed system is mixed with a relatively small amount of fresh air which has been supplied into the chamber, to form a rich mixture. This mixture flows into the combustion chamber which has been scavenged thoroughly with fuel-free air after passage through another scavenging passage. Therefore, the mixture thus introduced into the combustion chamber has an appropriate concentration and assures a satisfactory combustion, whereby both a high level of fuel economy and a high exhaust purifying performance are attained.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
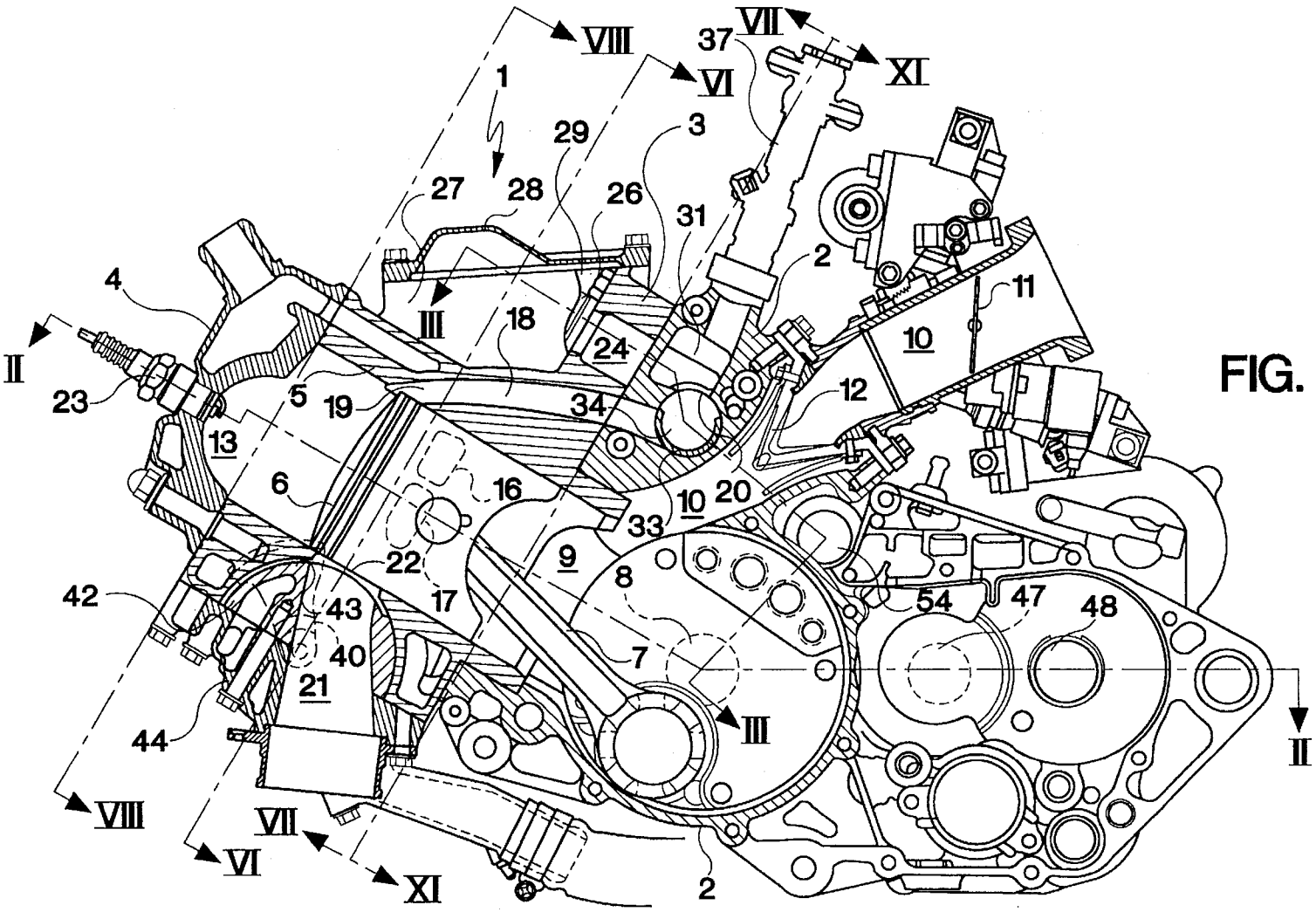
FIG. 1 is a longitudinal sectional view of an embodiment of the present invention.

An embodiment of the present invention illustrated in the drawings will be described hereinunder. In a spark ignition type two-cycle internal combustion engine 1 embodying the present invention, which is mounted on a two-wheeled motor vehicle (not shown), a cylinder block 3 and a cylinder head 4 are successively stacked above a crank case 2 and combined together integrally.

A piston 6 is inserted vertically slidably into a cylinder bore 5 formed in the cylinder block 3. The piston 6 and a crank shaft 8 are interconnected through a connecting rod 7 so that the crank shaft 8 is rotated with the ascent and the descent of the piston 6.

An intake passage 10 extending from the back to the front of the vehicle body is connected to an intake passage 10 in the crank case 2, with a throttle valve 11 and a reed valve 12 being disposed within the intake passage 10. The throttle valve is connected to a throttle grip (not shown) through a connection means (not shown) in such a manner that the opening of the throttle valve 11 is increased by twisting the throttle grip in one direction.

Further, a total of four, two each on the right and left sides, of the scavenging passages 14 and 15 which provide communication between the upper portion of the cylinder bore 5 and a crank chamber 9 are formed in the crank case 2 and the cylinder block 3. A scavenging passage 18 for the supply of a rich mixture is formed in a position closer to the rear portion of the vehicle body and in which position a scavenging opening 19 thereof is located higher than the scavenging openings 16 and 17 of the scavenging passages 14 and 15 for the supply of air. The scavenging passage 18 for the supply of a rich mixture extends downwardly from the scavenging opening 19 toward the intake passage 10 and is opened to a valve receiving hole 20 formed in the cylinder block 3 in parallel with the crank shaft 8. A cylinder bore 5 side exhaust opening 22, formed in the exhaust passage 21, is located in a position opposed to the scavenging opening 19.

In addition, a generally semispherical combustion chamber 13, formed above the cylinder bore 5, is offset toward the exhaust opening 22, and a spark plug 23 is disposed in the combustion chamber 13.

In the cylinder block 3, an air passage 24 is formed in a position just above the intake passage 10. In the underside of the cylinder block 3 which is in abutment with the crank case 2 there are formed air introducing slots 25 extending around the outer periphery of the cylinder bore 5 to provide communication between the scavenging passage 14 for the supply of air positioned closer to the intake passage 10 and the air passage 24. Above the air passage 24 is disposed a reed valve 26 as a crank chamber-side control valve, and a partition wall 27 is formed on the cylinder block 3 so as to enclose the reed valve 26, with a cover 28 being attached removably to an opening edge of the partition wall 27. The partition wall 27 and the cover 28 constitute a chamber 29.

Figure 4:
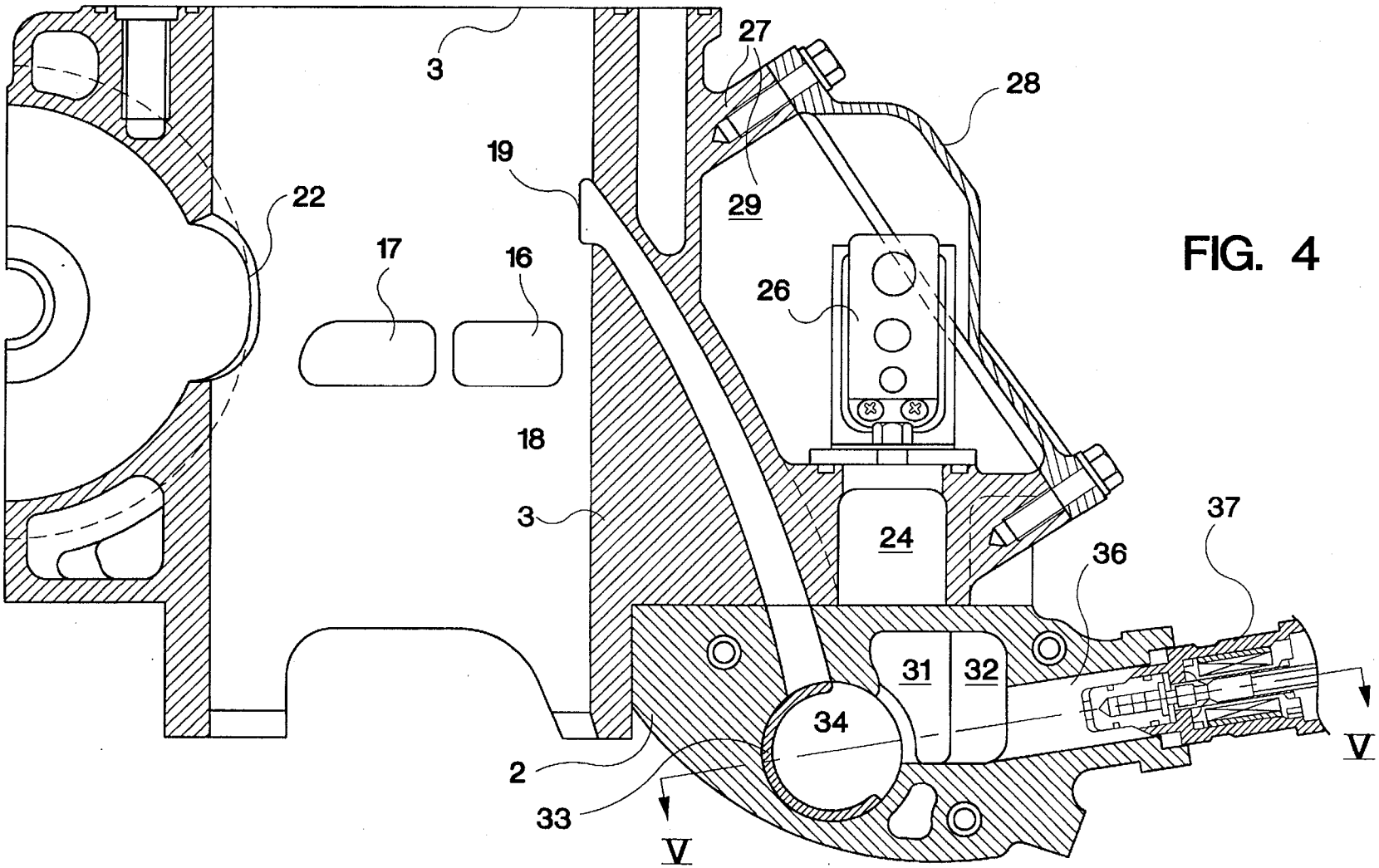
FIG. 4 is an enlarged longitudinal sectional view of a principal portion of FIG. 1.
Figure 5:
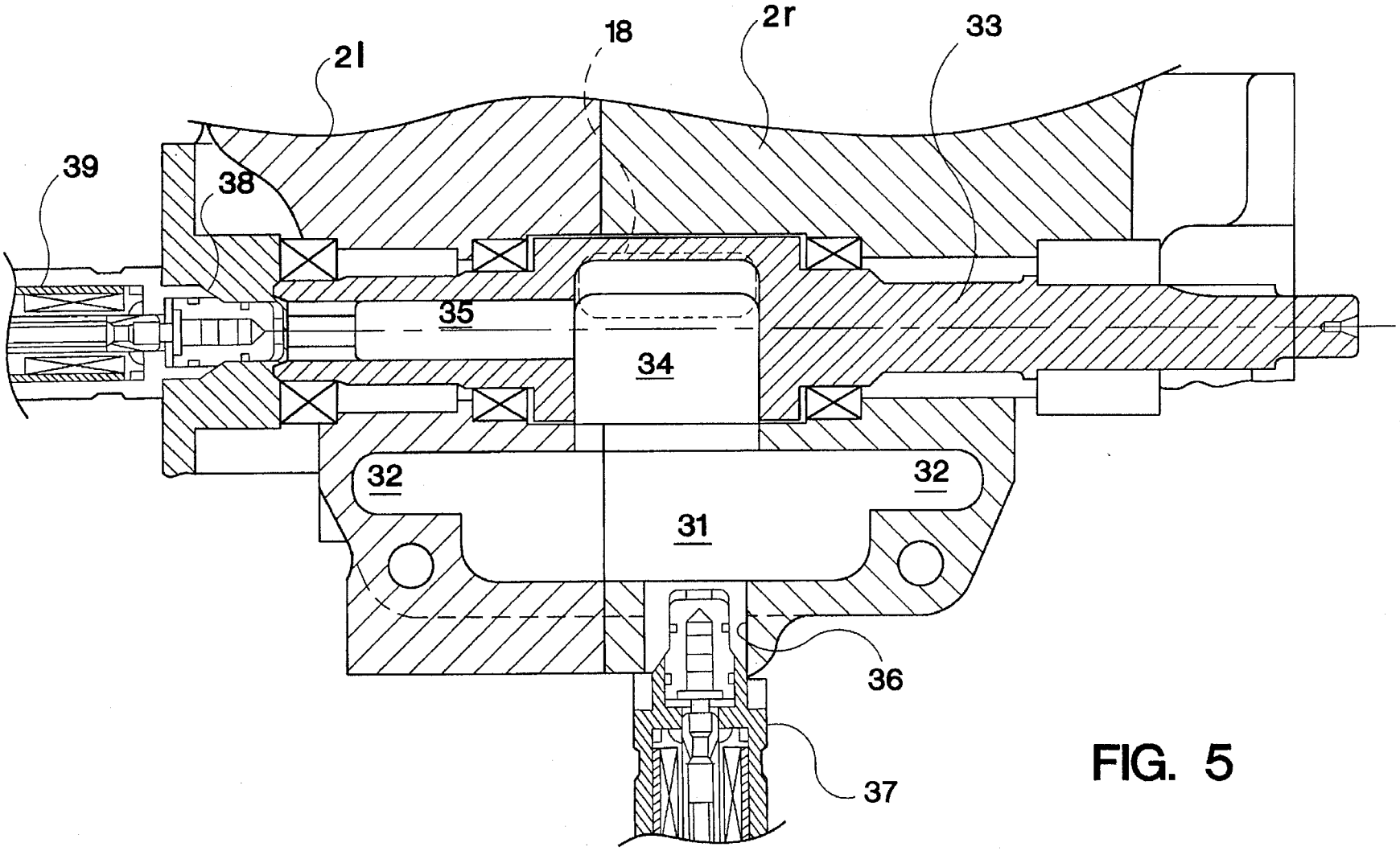
FIG. 5 is a plan view in transverse section taken along line V—V in FIG. 4.

In the cylinder block 3, moreover, vertically directed air passages 30 are formed on both right and left sides of the air passage 24. A mixing chamber 31 is formed in the crank case 2 which is in communication at both right and left ends thereof with the lower ends of the air passages 30 and centrally communicated through communication holes 32. A rotary valve 33 acting as a combustion chamber-side control valve is rotatably disposed in the valve receiving hole 20. A valve chamber 34 which is circumferentially open centrally in the longitudinal direction and a fuel introducing passage 35 extending from the left end of the rotary valve 33 and communicating with the valve chamber 34 are formed in the rotary valve 33. The rotary valve 33 is rotated in the same rotating direction, counterclockwise in FIGS. 1 and 4.

A fuel injection valve mounting hole 36 is formed in the crank case 2 from the rear portion of the vehicle body toward the mixing chamber 31. A fuel injection valve 37 is mounted in the hole 36. Further, from the left side face of the crank case 2 toward the fuel introducing passage 35 is formed a fuel injection valve mounting hole 38 which is in communication with the fuel introducing passage 35, with a fuel injection valve 39 being fitted in the hole 38.

Figure 6:
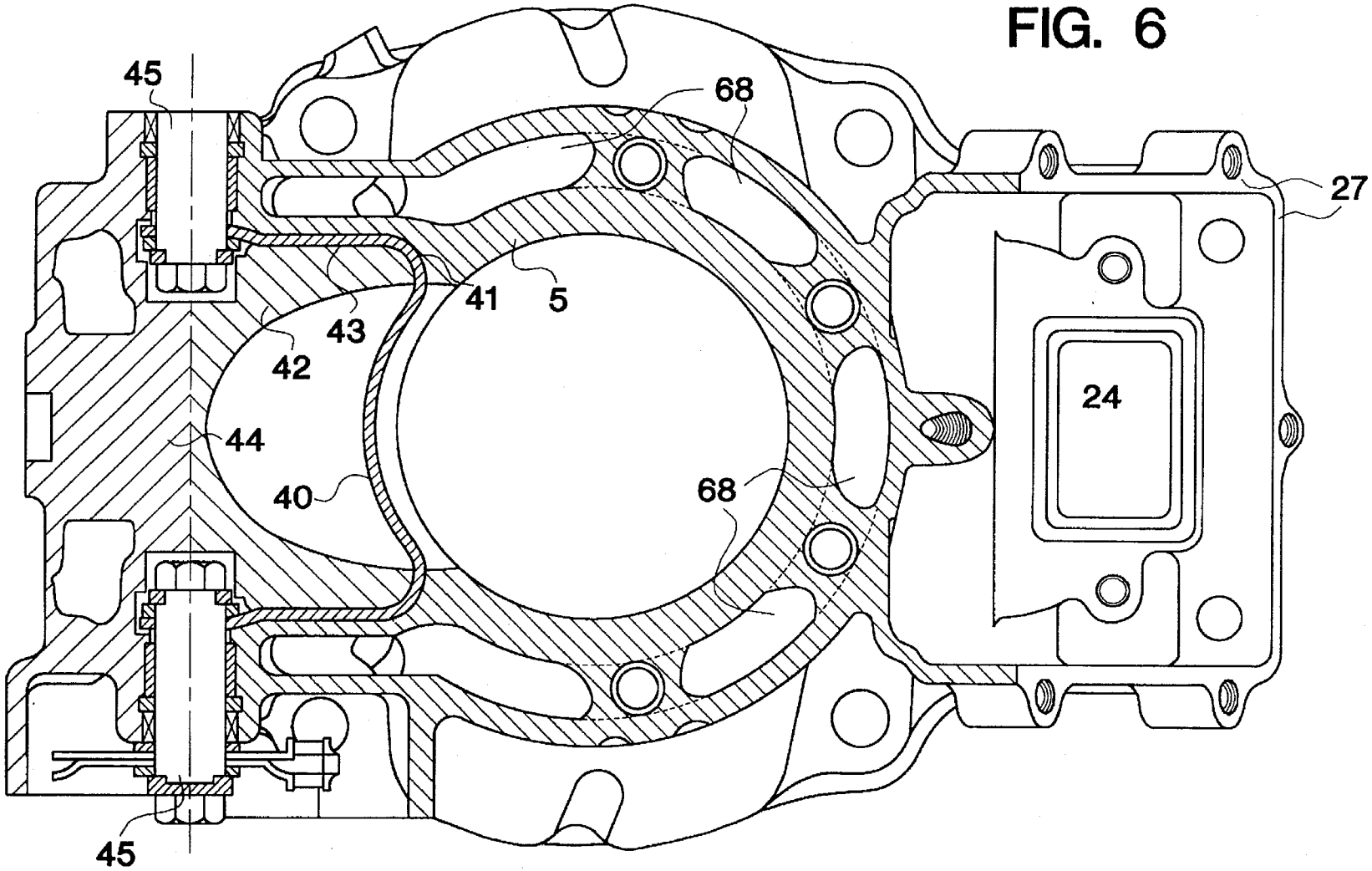
FIG. 6 is a plan view in transverse section taken along line VI—VI in FIG. 1.
Figure 7:
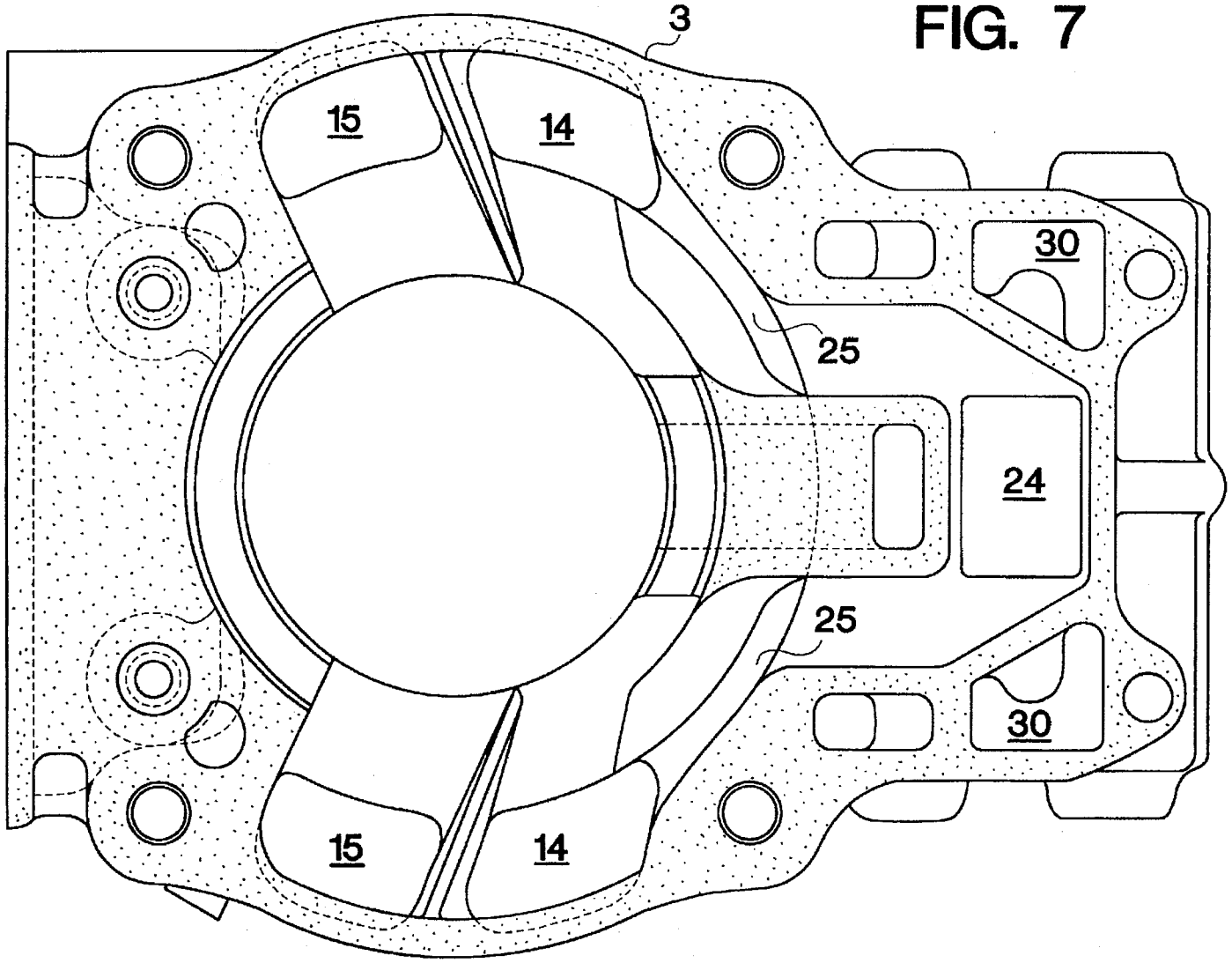
FIG. 7 is a view as seen in the direction of arrows VII—VII in FIG. 1, the dotted portions indicating faces of abutment with the crank case.
Figure 8:
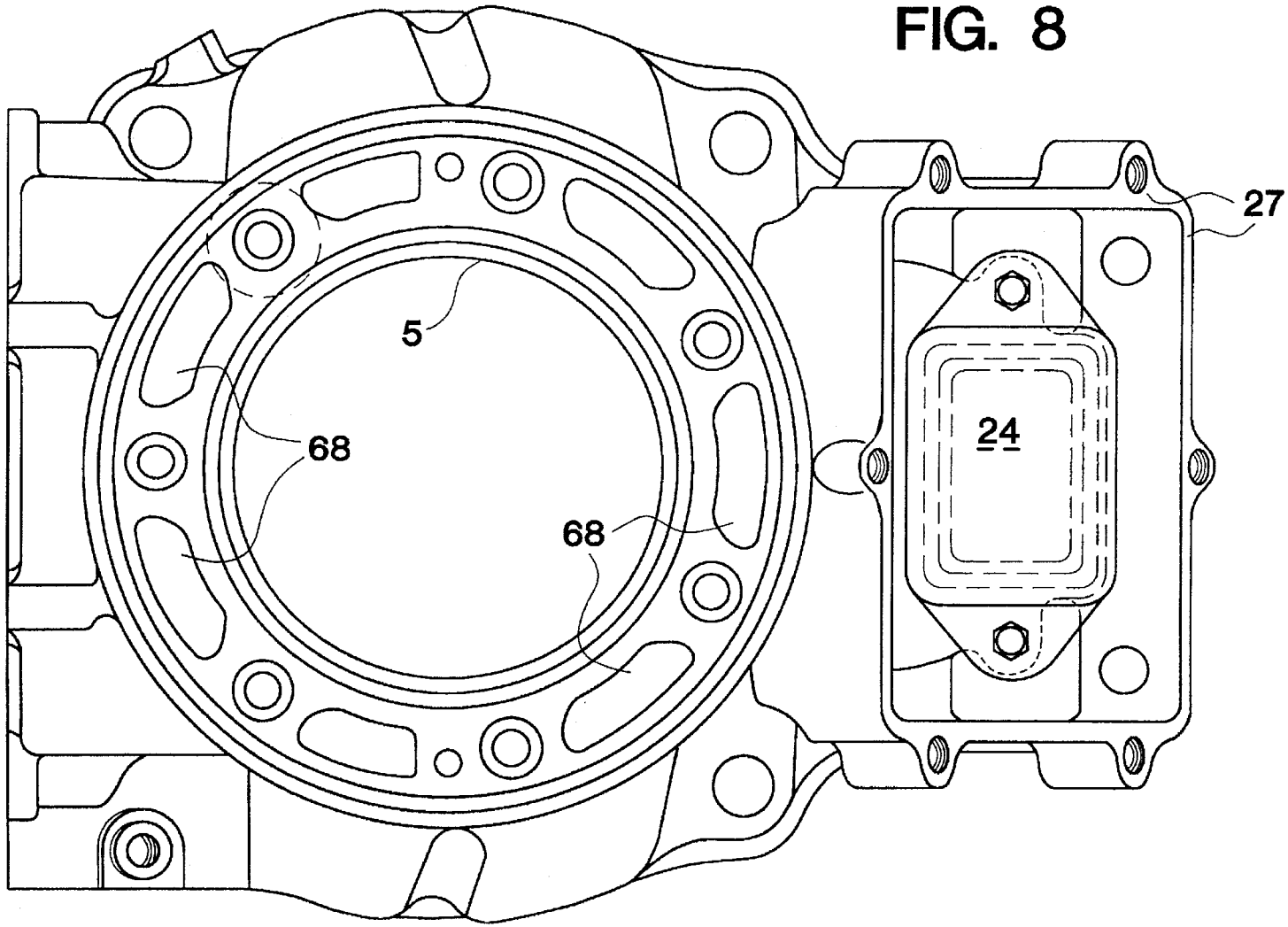
FIG. 8 is a view as seen in the direction of arrows VIII—VIII in FIG. 1.
Figure 9:
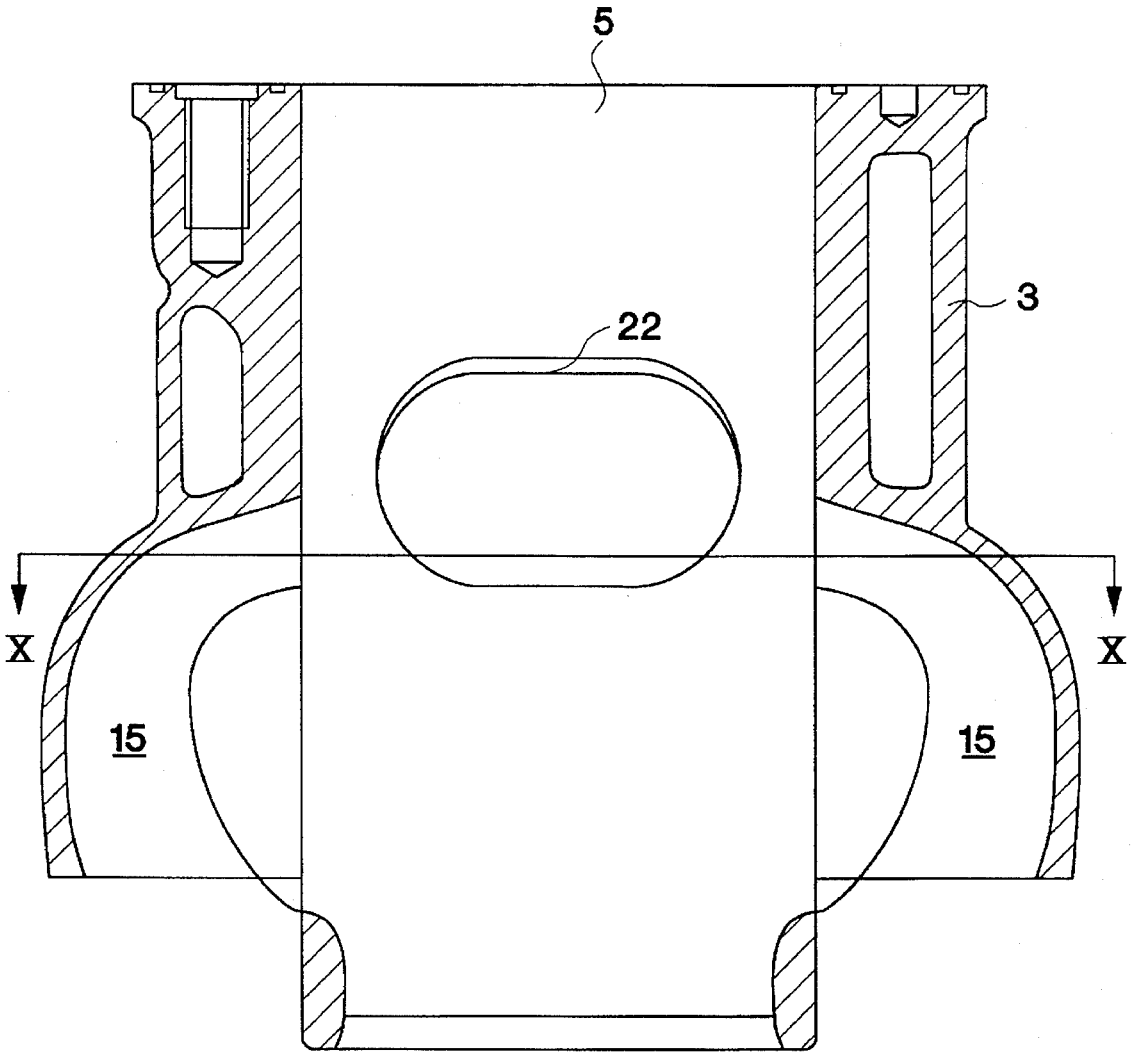
FIG. 9 is a front view in longitudinal section of a cylinder block.

As shown in FIGS. 1 and 6, an exhaust control valve 40 is disposed near the exhaust opening 22 of the exhaust passage 21. A gap 43 having a substantially uniform width is formed between a recess 41 formed in the cylinder block 3 and having an arcuate longitudinal section and an exhaust passage member 42 formed substantially in the same longitudinal sectional shape, and the exhaust control valve 40 is fitted in the gap 43. A base portion of the exhaust control valve 40, integrally mounted to rotating shafts 45, is rotatably supported by both the exhaust passage member 42 and an exhaust pipe mounting member 44 integrally combined with the exhaust passage member 42. The rotating shafts 45 are each connected to an exhaust control servomotor (not shown). The exhaust control servo-motor operates in accordance with a control signal outputted from a CPU (not shown) on the basis of an exhaust opening map using the degree of opening of the throttle valve 11 and the number of revolutions of the spark ignition type two-cycle internal combustion engine 1 as independent variables, whereby the exhaust control valve 40 is rocked so as to give an optimal exhaust opening conforming to the operating condition.

Figure 3:
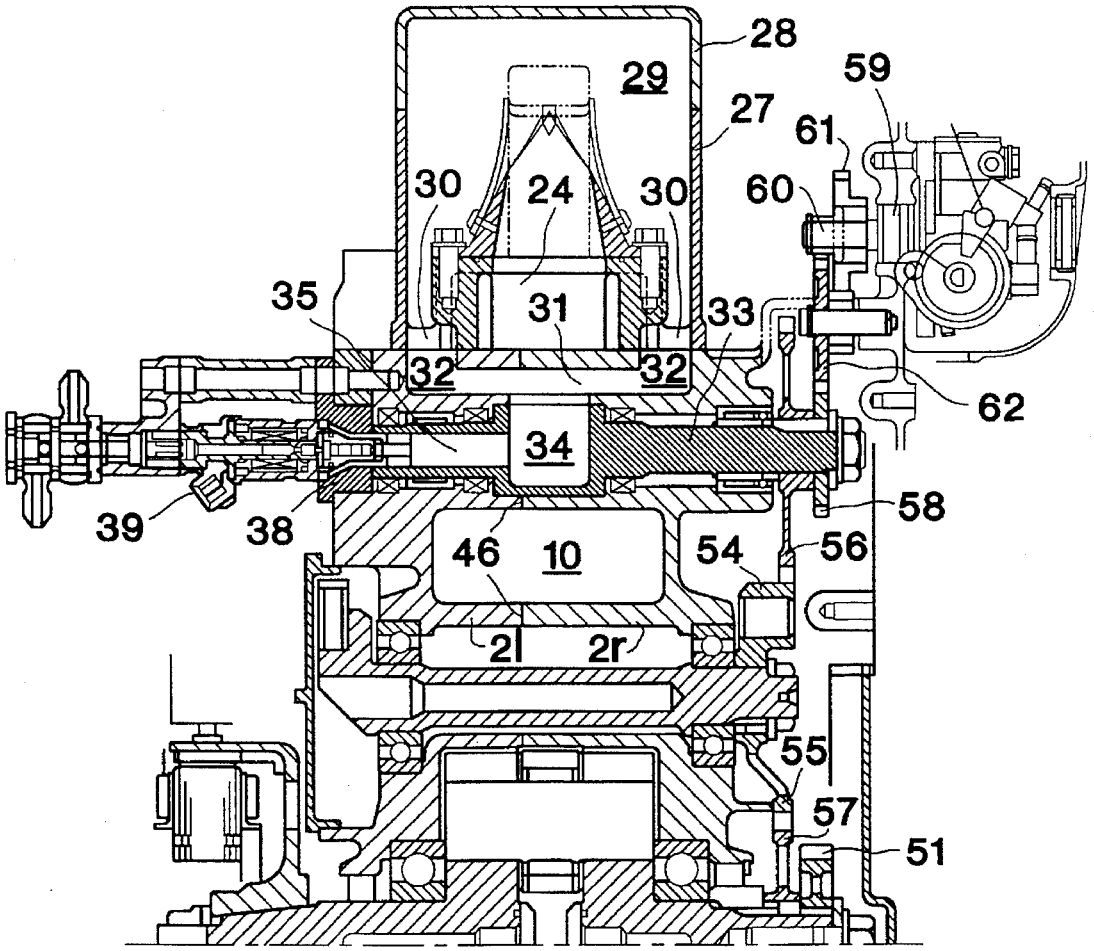
FIG. 3 is a longitudinal sectional view taken along line III—III in FIG. 1.
Figure 11:
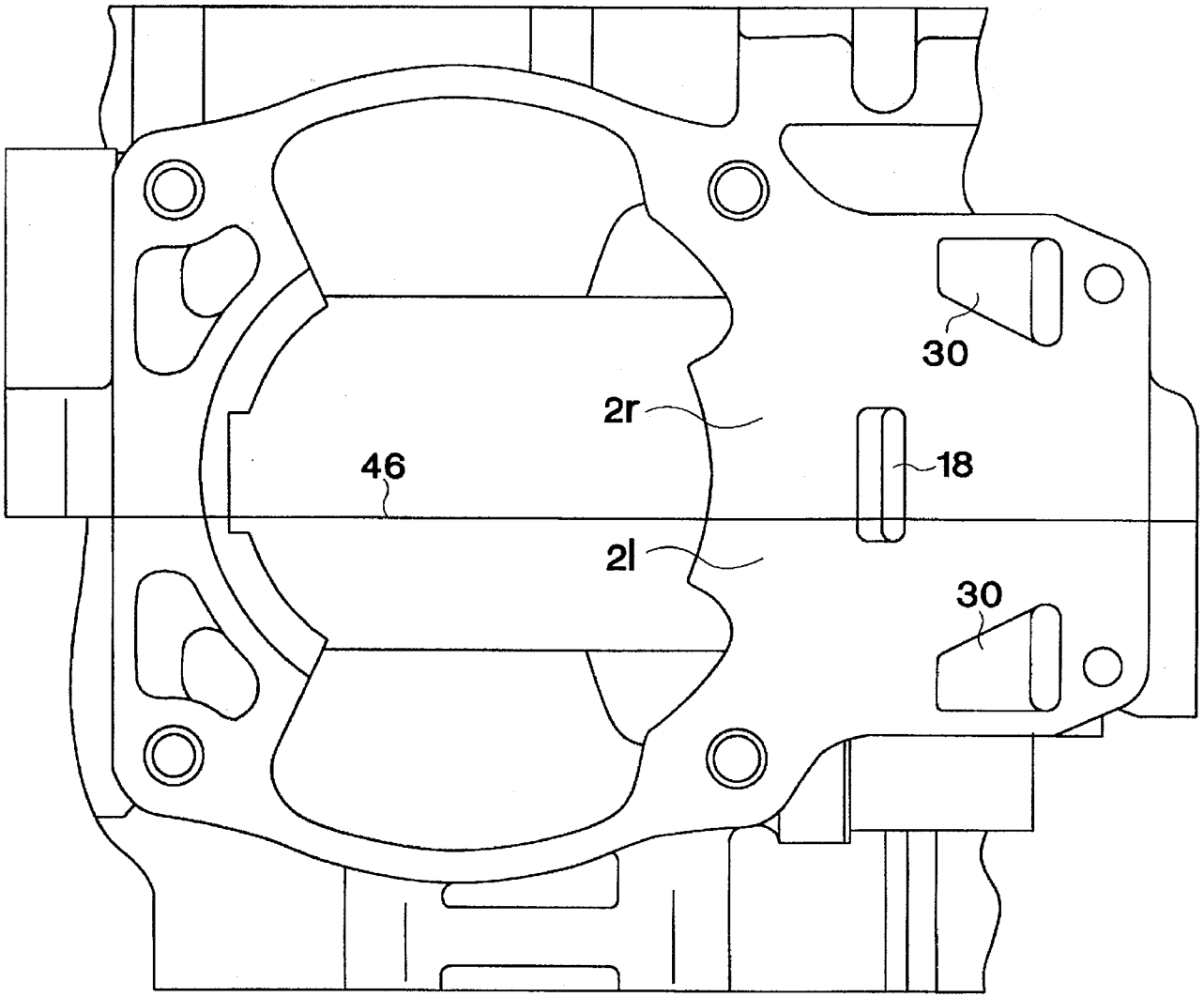
FIG. 11 is a view as seen in the direction of arrows XI—XI in FIG. 1.
Figure 12:
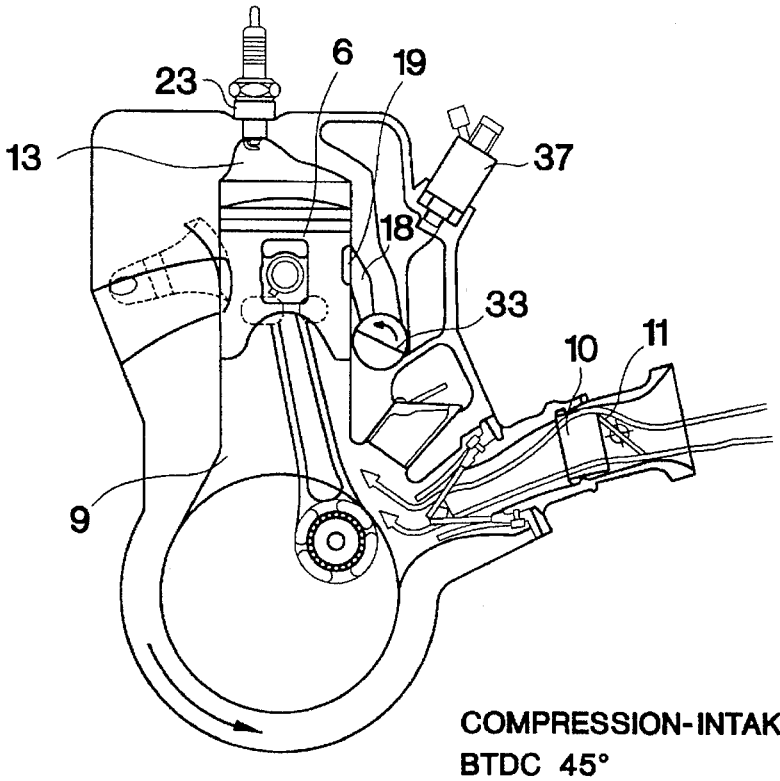
FIG. 12 is a diagram showing a state of 45° before arrival at the top dead center (TDC)

As shown in FIGS. 1, 3 and 11, the crank case 2 is split right and left into a left crank case 21 and a right crank case **2*r* with split faces 46 as a boundary. In positions behind the crank shaft 8 a main shaft 47 and a counter shaft 48 are supported rotatably by the left crank case 21 and the right crank case 2*r*. A clutch 49 is mounted on the main shaft 47 and a group of speed change gears 50 are mounted on the main shaft 47 and counter shaft 48**.

A driven gear 52 of the clutch 49 is brought into mesh with a driving gear 51 mounted on the right end of the crank shaft 8. A chain sprocket 53 is integrally mounted on the left end of the counter shaft 48, and an endless chain is entrained on both the chain sprocket 53 and a chain sprocket mounted to a rear wheel (not shown). When the spark ignition type two-cycle internal combustion engine 1 is started and the clutch 49 is set to an engaged state, the rotating force of the crank shaft 8 is transmitted via driving gear 51, driven gear 52, clutch 49, speed change gears 50 and counter shaft 48 to the chain sprocket 53, whereby the rear wheel is rotated.

In an obliquely upward position behind the crank shaft 8, a balancer weight 54 for cancelling a primary force of inertia of the crank shaft 8 is supported rotatably by both left and right crank cases 21, **2*r*. A balancer weight 55 is integrally mounted at the right end of the balancer weight 54, and a driven gear 56 is integrally mounted on the right-hand portion of the rotary valve 33. A driving gear 57 on the crank shaft 8, as well as the balancer gear 55 and driven gear 56, are successively brought into mesh with one another. Upon rotation of the crank shaft 8 the balancer weight 54 is rotated in the direction opposite to the crank shaft 8 and the rotary valve 33** is rotated in the same direction as the crank shaft, each at the same speed as the rotational speed of the crank shaft.

Further, a driving gear 58 is fitted on the right end of the rotary valve 33, a plunger type oil pump 59 is disposed adjacent the right-hand side of the rotary valve 33, and an intermediate gear 62 is in mesh with both the driving gear 58 and a driven gear 61 which is integrated with a drive shaft 60 of the oil pump 59. When the rotary valve 33 is rotated with rotation of the crank shaft 8, the oil pump 59 is operated.

Figure 2:
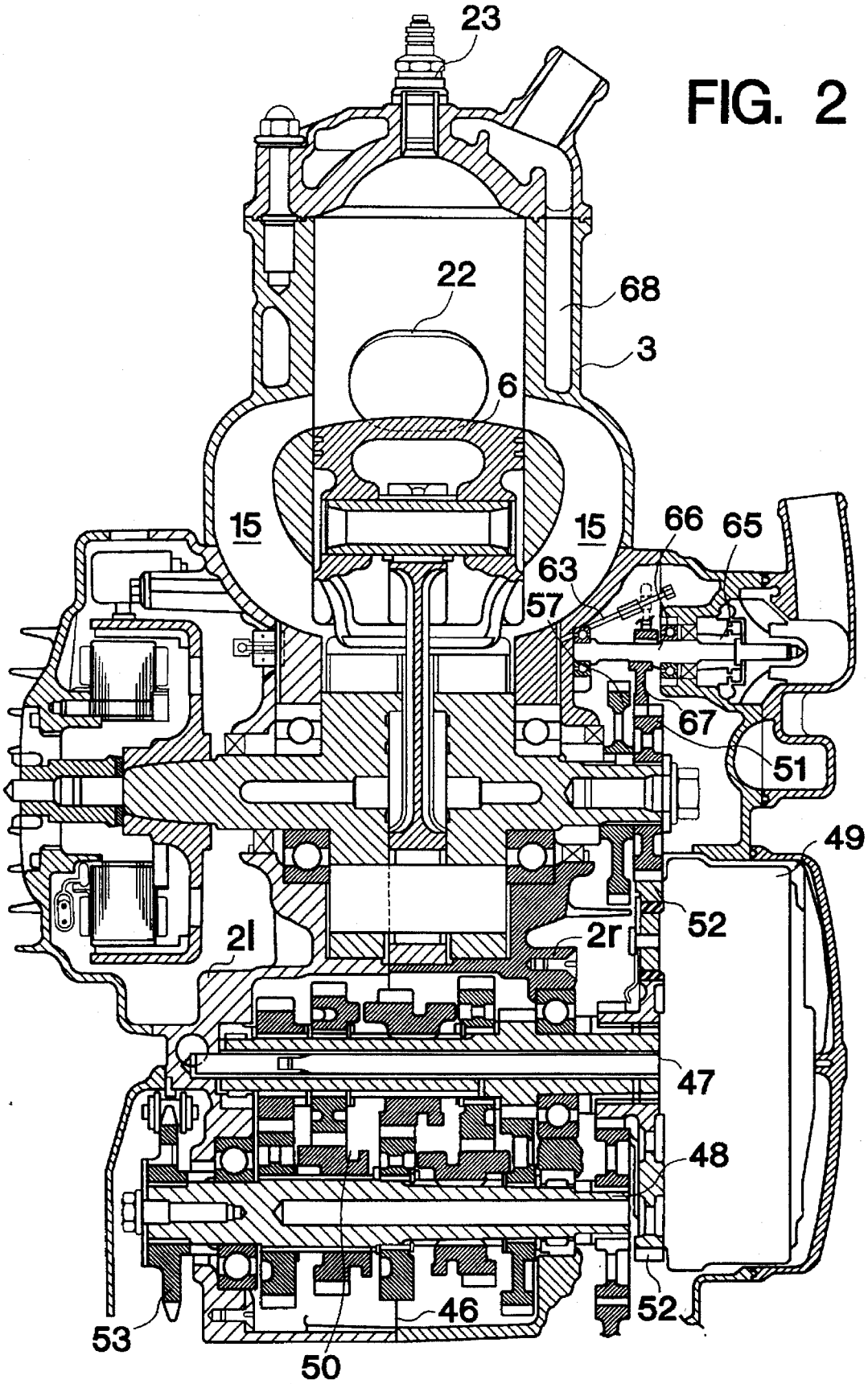
FIG. 2 is a longitudinal sectional view taken along line II—II in FIG. 1.
Figure 10:
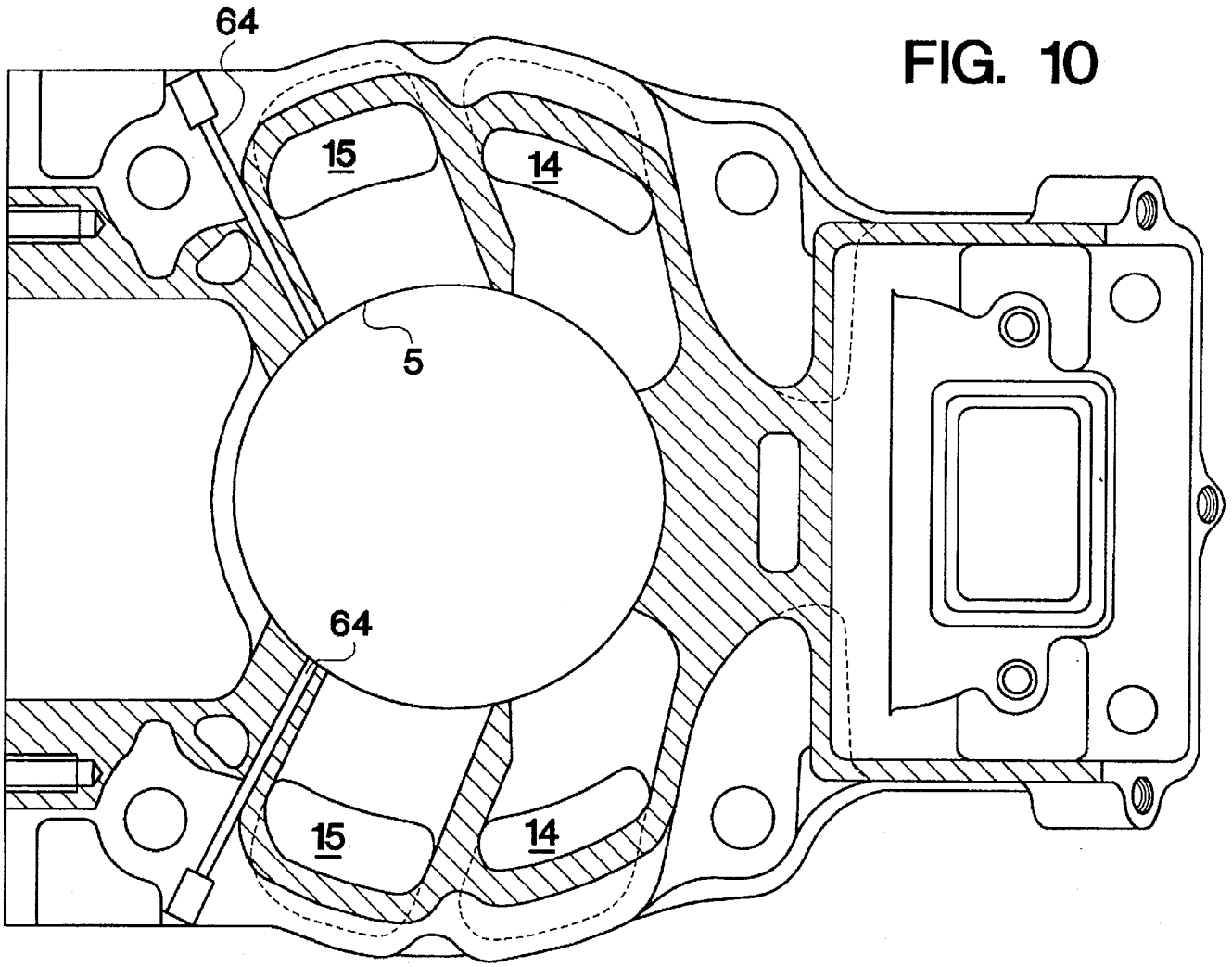
FIG. 10 is a plan view in transverse section taken along line X—X in FIG. 9.

Oil from the oil pump 59 is supplied to a bearing portion of the crank shaft 8 through an oil feed path 63, see FIG. 2, and is also supplied through an oil feed path 64, see FIG. 10, to the sliding portion between the cylinder bore 5 and the piston 6.

As shown in FIG. 2, a driven gear 67 integrated with a rotating shaft 66 of a water pump 65 is in mesh with the driving gear 51 mounted at the right end of the crank shaft 8. Upon start-up of the spark ignition type two-cycle internal combustion engine 1, the water pump 65 is rotated, so that the cooling water in the engine 1 is fed to a radiator (not shown) for cooling and again returns into a cooling water passage 68 in the engine 1.

The illustrated spark ignition type two-cycle internal combustion engine 1 is constructed as above, so when the crank shaft 8 is rotated counterclockwise in FIGS. 12 to 15 by means of a starter motor (not shown), the scavenging opening 19 of the scavenging passage 18 for the supply of a rich mixture is closed with the piston 6 at a time point of 75° ahead of the top dead center (TDC), so that the combustion chamber 13 is compressed, and the spark plug 23 is ignited at a predetermined timing ahead of the top dead center. Further, with the ascent of the piston 6, the crank chamber 9 continues to expand and the intake of air is continued, see FIG. 12.

Figure 13:
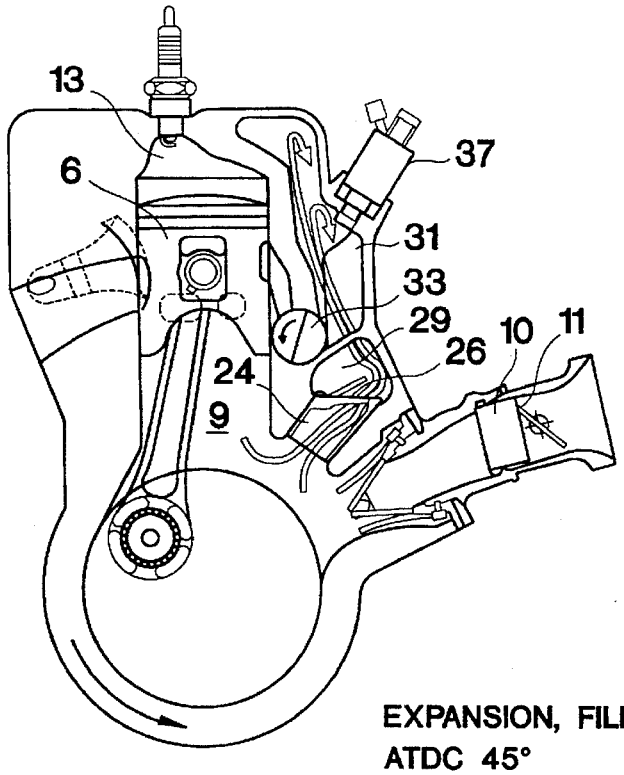
FIG. 13 is a diagram showing a state of 45° after passing the top dead center (TDC)
Figure 14:
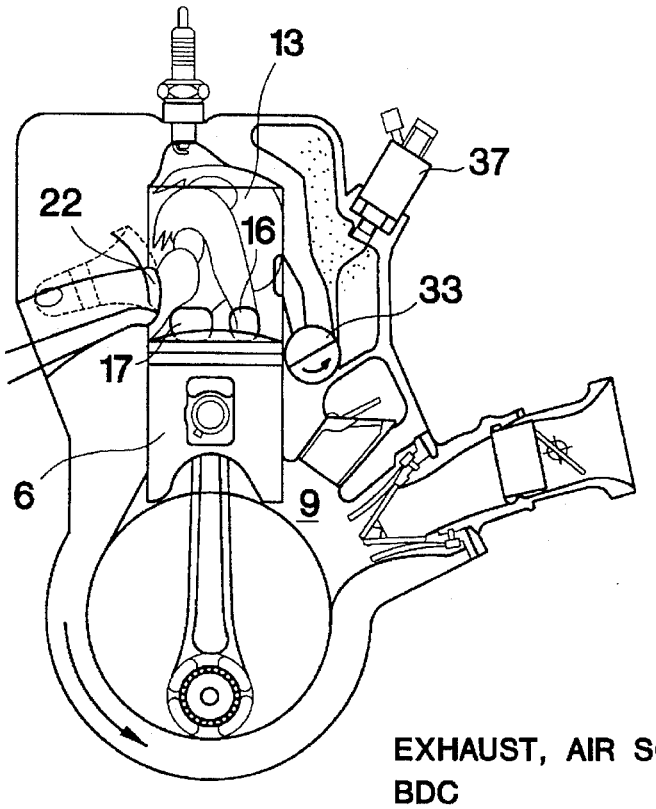
FIG. 14 is a diagram showing a state of arrival at the bottom dead center (BDC)
Figure 15:
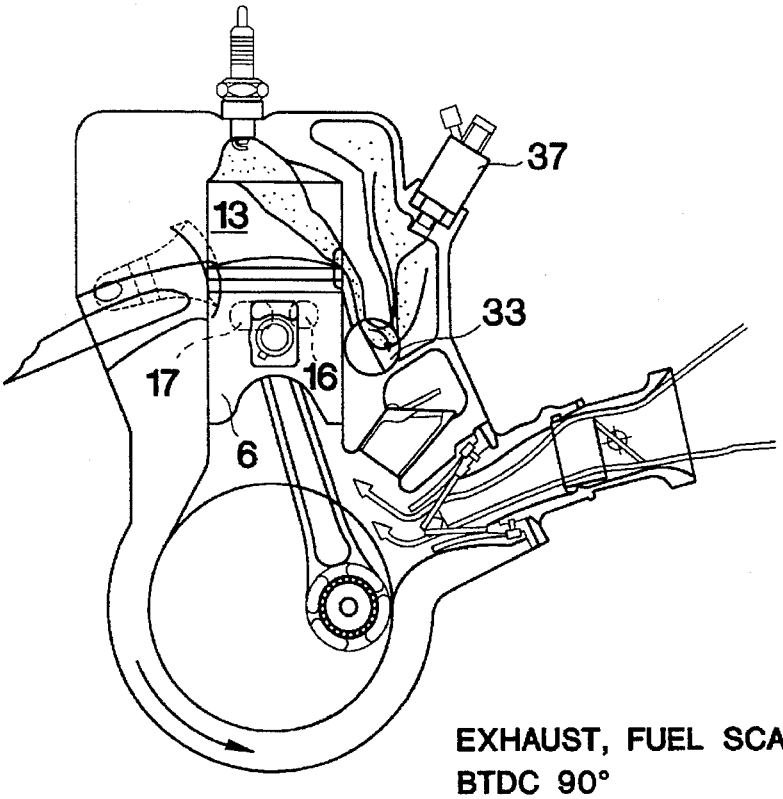
FIG. 15 is a diagram showing a state of 90° before arrival at the top dead center (TDC)
Figure 16:
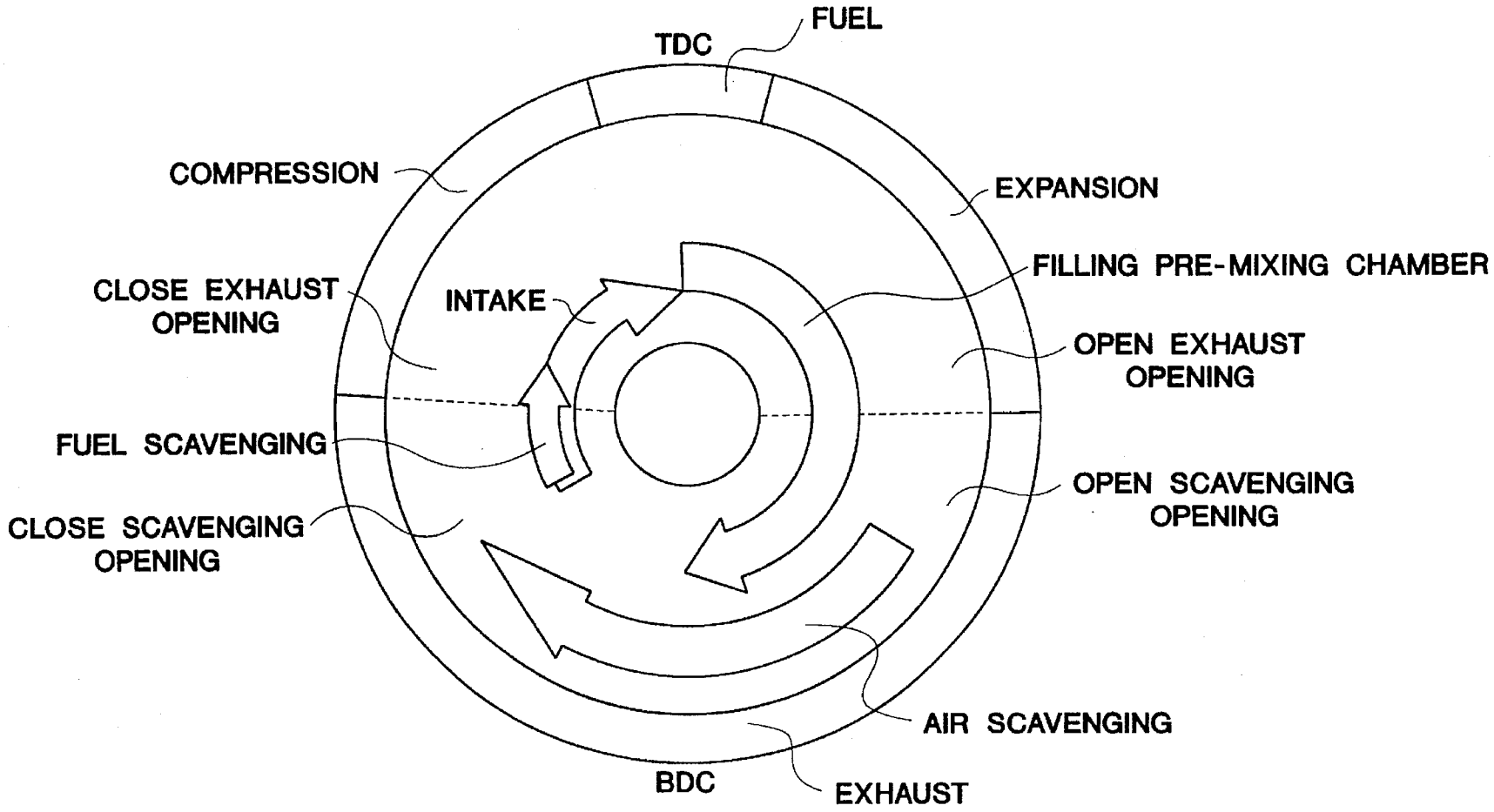
FIG. 16 is an explanatory view illustrating an operation cycle of this embodiment.

After the piston 6 has reached the top dead center (TDC), as shown in FIG. 13, the mixture in the combustion chamber 13 burns and expands, and as the piston descends, the crank chamber 9 is compressed to compress the air present therein. The thus compressed air flows from the scavenging passage 14 for the supply of air located near the intake passage 10 into the air passage 24 through the air introducing slots 25 and then from the interior of the air passage 24 into the chamber 29 through the reed valve 26.

Further, at a time point elapsed 90° from the top dead center (TDC), which time point varies depending on a vertical position of the exhaust control valve 40, the exhaust opening 22 is opened and the gas after combustion is discharged from the exhaust passage 21.

Then, at a time point of about 122° from the top dead center (TDC) the scavenging openings 16 and 17 are opened with the descent of the piston 6, resulting in that the air (free of fuel) present in the crank chamber 9 flows from the openings 16 and 17 into the combustion chamber 13 through the scavenging passages 14 and 15 for the supply of air, whereby the gas after combustion present in the combustion chamber 13 is forced out toward the exhaust opening 22, allowing scavenging to be effected with air alone. At the same time, fuel is injected into the mixing chamber 31 from the fuel injection valves 37 and 39 to produce a rich mixture, see FIG. 14.

Next, after a time of about 58° has elapsed from the bottom dead center (BDC) the scavenging openings 16 and 17 are closed with the ascent of the piston 6 to stop the scavenging performed by the inflow of air from both openings. At the same time, the valve chamber 34 in the rotary valve 33 is opened to both mixing chamber 31 and scavenging passage 18 for the supply of a rich mixture, so that the rich mixture present in the mixing chamber 31 passes through the interior of the scavenging passage 18 and is supplied into the combustion chamber 13 through the scavenging opening 19. In addition, since the crank chamber 9 expands with the ascent of the piston 6, air is introduced into the crank chamber from the intake passage 10 through the reed valve 12.

Thus, in the spark ignition type two-cycle internal combustion engine 1, since scavenging with only air is performed in the initial stage of scavenging, the blow-by phenomenon wherein the mixture passes through the combustion chamber 13 and is discharged to the exhaust passage 21, is prevented and it is thereby possible to improve fuel economy and prevent air pollution caused by the gas not having been subjected to combustion.

Even if the bearing portion of the crank shaft 8 and the sliding portion between the cylinder bore 5 and the piston 6 are not lubricated with the oil mixed in the fuel, which is ascribable to the supply of only air into the crank chamber 9, oil is supplied from the oil pump 59 to the crank shaft bearing portion and the cylinder-piston sliding portion through the oil feed paths 63 and 64, the two-cycle internal combustion engine 1 can perform an operation in a diminished state of frictional loss and it is also possible to prevent white-smoking caused by the oil mixed in the fuel.

Moreover, since two fuel injection valves 37 and 39 are provided, not only it is possible to eject a large amount of fuel but also it is possible to easily make a fine flow control while maintaining the metering accuracy at a high level.

Further, since the fuel injection valve 37 is disposed in the radial direction of the rotary valve 33 and the fuel injection valve 39 is disposed in the direction of the rotational axis of the rotary valve, both valves 37 and 39 can be disposed near the rotary valve 33 without mutual interference and therefore the fuel injection into the valve chamber 34 of the rotary valve 33 can be ensured. Moreover, it is possible to suppress the amount of fuel ejected from the fuel injection valve 37 and thereby prevent the fuel from remaining in the mixing chamber 31. Besides, it is possible to let the particles of fuel ejected from the fuel injection valves 37 and 39 to collide with one another and thereby attain a further atomization of the fuel.

Additionally, since the fuel injection valve 39 is disposed on the rotational axis of the rotary valve 33, fuel can be injected into the valve chamber 34 irrespective of the opening position of the valve chamber 34 in the rotary valve 33. In addition, the fuel can be ejected from the fuel injection valve 39 so as to intersect a radial air current passing through the valve chamber 34 in the rotary valve 33, thereby permitting the fuel to be mixed with the intake air to a sufficient extent. Consequently, it is possible to accelerate the atomization.

Further, in a precommunicated state when the interior of the mixing chamber 31 and the valve chamber 34 in the rotary valve 33 comes into communication with the scavenging passage 18 for the supply of a rich mixture, even if fuel in a liquid state remains in the vicinity of the rotary valve 33, such liquid fuel adheres to the valve chamber 34 side in the rotary valve 33 and can be atomized by a current of air from the beginning of the next opening period.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. In a two-cycle internal combustion engine having a first chamber formed in a scavenging passage communicating between a crank chamber and a combustion chamber, with a sealable inlet control valve being disposed in an inlet of said first chamber and a sealable outlet control valve being disposed in an outlet of said first chamber and a fuel feed system for supplying fuel into said first chamber comprising:

said first chamber being in selective communication with a second scavenging passage; and the sealable outlet control valve being disposed in the outlet of the first chamber formed on the combustion chamber side and on a scavenging downstream side and being positioned on a bottom portion of the second scavenging passage communicating with a mixing chamber with respect to the sealable inlet control valve disposed in the inlet on the crank chamber side.

2. The two-cycle internal combustion engine according to claim 1, wherein a fuel feed system for the supply of atomized fuel is disposed in the vicinity of the combustion chamber side outlet control valve.

3. The two-cycle internal combustion engine according to claim 1, wherein the inlet sealable control valve is a reed valve operatively positioned adjacent to said first chamber for selectively supplying air thereto.

4. The two-cycle internal combustion engine according to claim 1, wherein the outlet sealable control valve is a rotatable valve selectively opened for supplying a mixture of air and fuel to said combustion chamber.

5. The two-cycle internal combustion engine according to claim 4, wherein said outlet sealable control valve includes a valve chamber circumferentially open centrally in a longitudinal direction and a fuel introducing passage being in communication with the valve chamber.

6. The two-cycle internal combustion engine according to claim 1, and further including a piston operatively mounted for reciprocation within said combustion chamber, said piston including openings disposed on a sidewall thereof for supplying air, free of fuel, into scavenging passages for supply to said combustion chamber upon a descent of said piston.

7. The two-cycle internal combustion engine according to claim 6, wherein exhaust gas disposed within said combustion chamber is discharged by use of air supplied through said scavenging passages.

8. The two-cycle internal combustion engine according to claim 7, wherein air is introduced into said crank chamber upon an ascent of the piston into said combustion chamber.

9. The two-cycle internal combustion engine according to claim 6, wherein blow-by phenomenon is prevented by utilizing air for scavenging and thereby increasing fuel economy and preventing air pollution.

10. The two-cycle internal combustion engine according to claim 1, and further including a driving gear operatively connected to said outlet control valve for selectively imparting rotation thereto for opening and closing said outlet control valve.

11. In a two-cycle internal combustion engine having a first chamber in communication between a crank chamber and a combustion chamber, with an inlet control valve being disposed in an inlet to said first chamber and an outlet control valve being disposed in an outlet of said first chamber and a fuel feed system for supplying fuel into said first chamber comprising:

a scavenging passage being in selective communicaion with said first chamber; and said outlet control valve being disposed in the outlet of the first chamber formed on the combustion chamber side, said outlet control valve being positioned for closing said scavenging passage on a downstream side and being disposed adjacent to a bottom portion of the scavenging passage and in communication with a mixing chamber, and said inlet control valve being disposed in the inlet to the first chamber on the crank chamber side.

12. The two-cycle internal combustion engine according to claim 11, wherein a fuel feed system for the supply of atomized fuel is disposed in communication with the mixing chamber.

13. The two-cycle internal combustion engine according to claim 11, wherein the inlet control valve is a reed valve operatively positioned adjacent to said first chamber for selectively supplying air thereto.

14. The two-cycle internal combustion engine according to claim 11, wherein the outlet control valve is a rotatable valve selectively opened for supplying a mixture of air and fuel to said combustion chamber.

15. The two-cycle internal combustion engine according to claim 14, wherein said outlet control valve includes a valve chamber circumferentially open centrally in a longitudinal direction and a fuel introducing passage being in communication with the valve chamber.

16. The two-cycle internal combustion engine according to claim 11, and further including a piston operatively mounted for reciprocation within said combustion chamber, said piston including openings disposed on a sidewall thereof for supplying air, free of fuel, into scavenging passages for supply to said combustion chamber upon a descent of said piston.

17. The two-cycle internal combustion engine according to claim 16, wherein exhaust gas disposed within said combustion chamber is discharged by use of air supplied through said scavenging passages.

18. The two-cycle internal combustion engine according to claim 17, wherein air is introduced into said crank chamber upon an ascent of the piston into said combustion chamber.

19. The two-cycle internal combustion engine according to claim 16, wherein blow-by phenomenon is prevented by utilizing air for scavenging and thereby increasing fuel economy and preventing air pollution.

20. The two-cycle internal combustion engine according to claim 11, and further including a driving gear operatively connected to said outlet control valve for selectively imparting rotation thereto for opening and closing said outlet control valve.

* * * * *